United States Patent [19]

Scott et al.

[11] Patent Number: 4,512,135

[45] Date of Patent: Apr. 23, 1985

[54] LOCKING MECHANISM FOR WRAP-AROUND CARTONS

[75] Inventors: Dale K. Scott, Jonesboro; Rodney K. Calvert, Dunwoody, both of Ga.

[73] Assignee: The Mead Corporation, Dayton, Ohio

[21] Appl. No.: 493,873

[22] Filed: May 12, 1983

[30] Foreign Application Priority Data

Jun. 12, 1982 [GB] United Kingdom ..... 8217109

[51] Int. Cl.[3] ..... B65B 7/24; B65B 11/10

[52] U.S. Cl. ..... 53/285; 53/48

[58] Field of Search ..... 53/48, 209, 285, 398; 74/54, 569

[56] References Cited

U.S. PATENT DOCUMENTS 3,540,185 11/1970 Gentry ..... 53/201 X
3,543,473 12/1970 Cato ..... 53/48
3,701,230 10/1972 Gentry ..... 53/48

*Primary Examiner*—Robert L. Spruill
*Assistant Examiner*—Michael D. Folkerts
*Attorney, Agent, or Firm*—Erwin Doerr

[57] ABSTRACT

The invention relates to a locking mechanism for locking together overlapping base panels of a wrap-around type carton. The mechanism comprises a locking element (50) pivotally mounted on carton conveying means (10) for movement therewith and including a locking finger (60) for insertion into said base panels to form a lock therebetween, a rotatable cam disc (62) for cooperation with a first follower leg (56) provided by the locking element for pivoting the locking finger into a locking position, and a rotatable cam disc (66) for cooperation with a second follower leg (58) provided by the locking element for pivoting the locking finger into a retracted position. The cam discs (62,66) are located at spaced locations along the path of movement of the locking element for interference therewith such that said second follower leg (58) automatically is brought into a position for engagement with its respective cam disc (66) during cooperation between the first follower leg (56) and its respective cam disc (62) and vice versa, whereby the locking element is pivoted sequentially into its locking and retracted positions.

4 Claims, 3 Drawing Figures

LOCKING MECHANISM FOR WRAP-AROUND CARTONS

This invention relates to a locking mechanism for locking together overlapping base panels of a wrap-around type carton. The mechanism is particularly, although not exclusively, suitable for cooperation with the blank of the wrap-around type carton as disclosed in U.S. Pat. No. 4,243,143. Further, the mechanism is suitable for incorporation into a carton locking unit such as that disclosed in U.S. patent application Ser. No. 462,163 filed Jan. 31, 1983.

Locking mechanisms for performing a similar function to that of the present invention are known, for example, from U.S. Pat. No. 3,540,185 (Gentry), U.S. Pat. No. 3,543,473 (Cato) and U.S. Pat. No. 3,701,230 (Gentry). While these known mechanisms perform satisfactorily, it has been found that in certain applications, such as in use with a carton of the kind disclosed in aforementioned U.S. Pat. No. 4,243,143 difficulty is experienced in achieving a reliable and consistent locking function and in achieving positive disengagement of the locking elements from a carton during the locking operation.

The present invention seeks to overcome those difficulties in performance of such mechanisms and provides a locking mechanism for locking together overlapping base panels of a wrap-around carton, which mechanism comprises a locking element pivotally mounted on carton conveying means for movement therewith and including a locking finger for insertion into said base panels to form a lock therebetween, a cam surface for cooperation with a first cam follower provided by said locking element for pivoting the locking finger into a locking position, and a cam surface for cooperation with a second cam follower provided by said locking element for pivoting the locking finger into a retracted position, characterized in that said cam surfaces are located at spaced locations along the path of movement of said locking element for interference therewith such that said second cam follower automatically is brought into a position for engagement with its respective cam surface during cooperation between said first cam follower and its respective cam surface and vice versa, whereby said locking element is pivoted sequentially into its locking and retracted positions.

Figure 1:
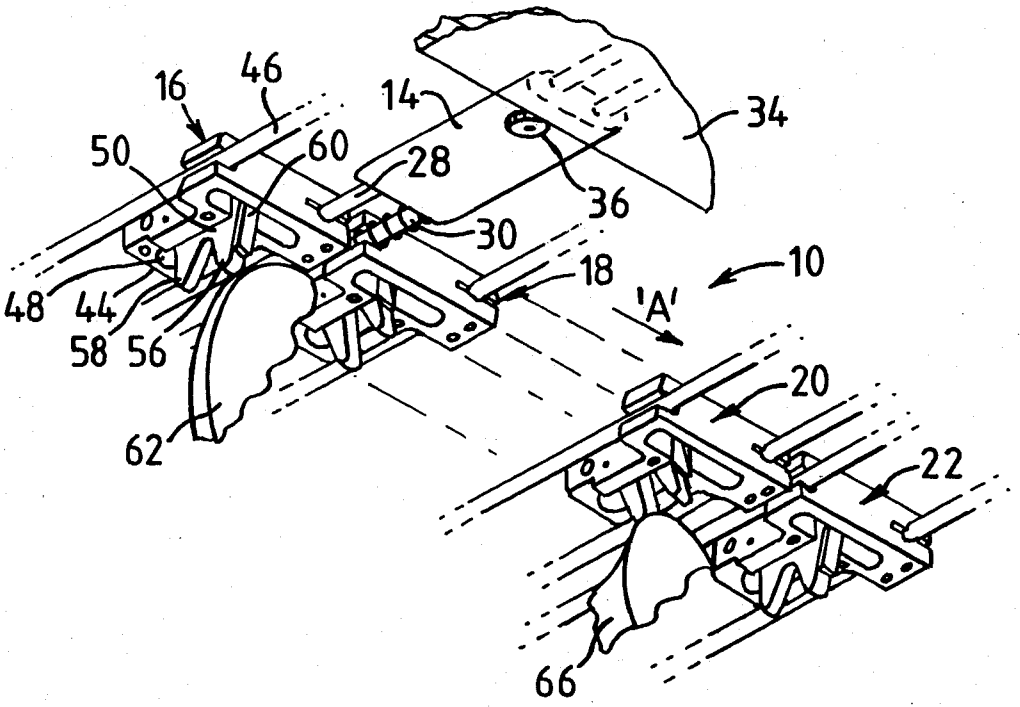
Figure 3:
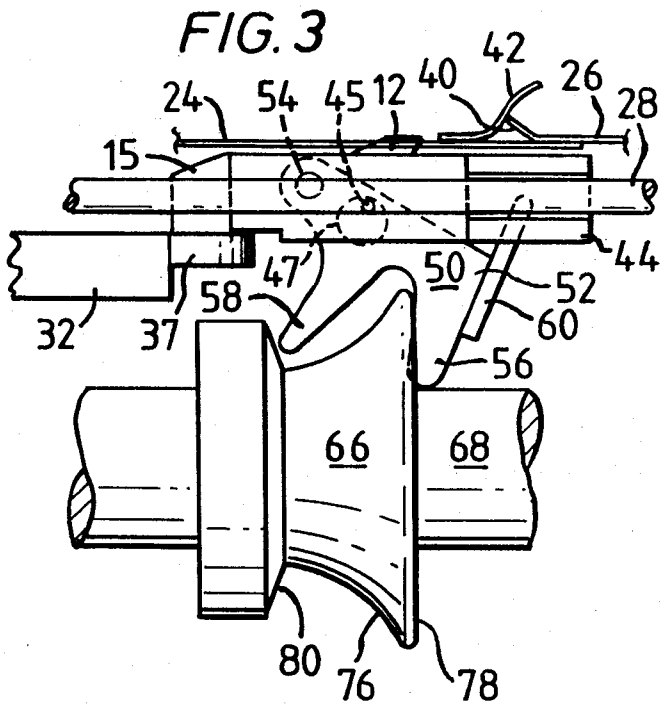
Figure 2:
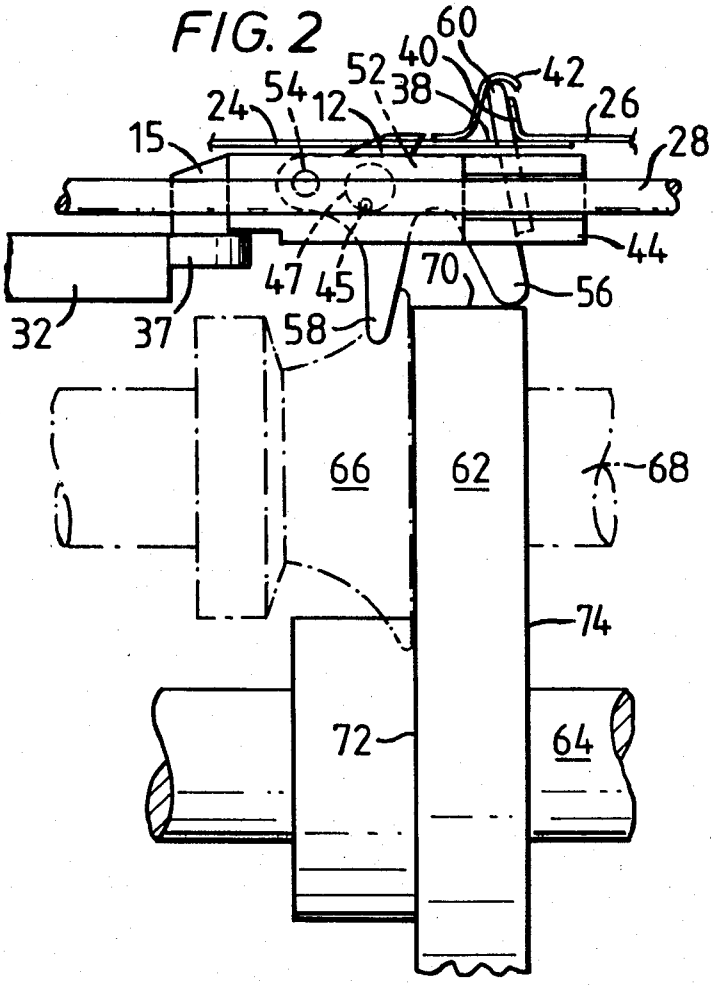

An embodiment of the invention is now described, by way of example, with reference to the accompanying drawings, in which:

FIG. 1 is perspective view taken from beneath the carton conveying path of a locking mechanism and showing, at least partially, the main components of the mechanism, FIG. 2 is an end elevation of components of the mechanism showing the locking element pivoted into its locking position, and FIG. 3 is a further end elevation of components of the mechanism showing the locking element pivoted into its retracted position.

Referring to the drawings, there is shown components of a carton tightening and locking mechanism including a carton conveying means generally designated reference numeral 10 (FIG. 1). As previously mentioned, mechanisms of similar type to that according to the present invention are known and each functions to engage and tighten a wrap-around carton about its contents and subsequently lock together overlapping base panels of the carton.

A series of tightening projections, such as projection 12, (FIGS. 2 and 3), are carried by supports, such as support 14, 15 (FIG. 1), and arranged in opposed pairs along a carton conveying path (see arrow 'A', FIG. 1) of the mechanism. A series of locking devices e.g. 16–22 are mounted centrally of the carton conveying path in the mechanism, flanked by the tightening projection supports 14, 15. The tightening projections 12 are sized and shaped for insertion into cooperating tightening apertures provided in the two overlapped base panels 24, 26 (FIGS. 2 and 3) of a carton wrapper.

A suitable tightening operation fundamentally is described in the aforementioned U.S. Pat. No. 4,243,143. In order to tighten the wrapper about its contents, each opposed pair of tightening projection supports are caused to be resiliently urged transversely of the carton conveying path so that the tightening projection pairs are moved towards one another while the filled wrapper advances along the conveying path of the mechanism. To achieve this, the pairs of opposed supports, e.g. supports 14, 15 are mounted on transverse guide rods, such as guide rods 28, 30 (FIG. 1). Each guide rod is connected at each of its ends to an endless chain (not shown). The two chains revolve continuously and carry the filled wrapper, guide rods and tightening projections supports, and the locking devices with them. During movement of the chains, the tightening projection supports are caused to engage a guide rail located beneath each chain. One guide rail 34 is fixed and is located on that side of the mechanism adjacent carton base panel 24, whereas the other guide rail 32 (FIG. 2), located adjacent carton base 26, is mounted for transverse movement towards and away from the fixed guide rail. A pneumatic piston and cylinder device (not shown) exerts a predetermined force to cause guide rail 32 to shift resiliently from a retracted position to an inwardly displaced position. The guide rails are shaped to present inclined leading and trailing ramp edges to the tightening projection supports and each support has a roller or other guide follower which is positioned to travel along the ramp edges of its associated guide rail. For example, support 14 carries roller follower 36 for engagement with guide rail 34 and support 15 carries roller follower 37 for engagement with guide rail 32. When the rollers of the tightening projection supports travel along the leading ramp edge of the associated guide rail, the tightening projections are caused to move inwardly towards one another in order to tighten the wrapper about its contents. By this arrangement each tightening projection necessarily is moved into a position predetermined by its associated guide rail so that a locking aperture 38 defined by tab 40 (FIG. 2) always arrives at a position in which a locking finger can punch a locking tab 42 of the wrapper upwardly through the locking aperture 38. The tightening projection is displaced inwardly until a force predetermined by the pressure in the pneumatic cylinder, and corresponding to the desired maximum pulling force for the wrapper, is obtained. In this position, in which the wrapper has been tightened to the desired extent, the locking operation takes place.

For performing the locking operation, a plurality of locking devices 16–20 (FIG. 1) act on the wrapper sequentially and/or simultaneously depending on the arrangement of locking tabs and the corresponding locking apertures provided in the wrapper base panels.

In the construction illustrated the locking devices 16–20 are located in tandem and oriented in the same direction transversely of carton conveyor path. As such the mechanism is suitable for locking together wrapper base panels having locking tabs/apertures arranged in-line.

With reference to locking device 16, each device comprises a carrier block 44 detachably connected to adjacent transverse guide rods 46, 16 intermediate the locking projection supports 14,15. The other carrier blocks of the mechanism are similarly mounted and the arrangement provides a continuous array of such carriers driven by the endless chains of the mechanism. FIG. 1 shows only those locking devices which have travelled into parallel relationship with respect to the carton conveying path 'A'.

Carrier block 44 includes a shaped aperture 48 in which a locking element 50 pivotally is mounted. Locking element 50 (see FIGS. 2 and 3) comprises a body part 52 which is pivotally connected at one of its ends to the carrier block 44 by pivot pin 54. The body part 52 is bifurcated to provide a pair of downwardly extending fixed cam follower legs 56, 58 respectively. Both follower legs 56 and 58 extend in the same general direction away from a notional plane passing through the body part of the locking element and which contains the pivot axis. The first follower leg 56 is disposed at that end of the locking element which is remote from the pivot axis and carries an upwardly projecting locking finger 60. Locking finger 60 extends in the opposite direction to that of the follower legs away from the said notional plane. The second follower leg 58 is spaced from first follower leg 56 and is disposed intermediate the first follower leg and the pivot axis of the locking element.

A first cam disc 62 is rotatably mounted on shaft 64 below and in the path of movement of the locking element 50 for cooperation with the first follower leg 56. A second cam disc 66 is rotatably mounted on shaft 68 below and in the path of movement of the locking element 50 for cooperation with the second follower leg 58. The first and second cam discs are spaced apart in the direction of the carton conveying path and also displaced relative to one another transversely of the conveying path.

During operation, immediately prior to performing a locking function, the locking element 50 approaches the first cam disc whilst in its retracted position shown in FIG. 3. When in this position the first follower leg 56 is aligned for engagement with the first cam disc 62. In order to effect pivotal movement of the locking element into its locking position the first follower leg and cam disc are thus positioned for interference with one another such that the first follower leg 56 strikes an upper part of the peripheral edge 70 of the first cam disc 62, and is caused to ride on the peripheral edge whilst simultaneously moving across the peripheral edge from one disc face 72 to the opposite disc face 74 during rotation of the disc. The first disc is of constant diameter as measured across its peripheral edge and hence this cooperation between the first follower leg and cam disc results in the locking element being pivoted into its locking position as illustrated in FIG. 2. Thus, the locking finger 60 carried by first follower leg 56 punches the locking tab 42 of wrapper base panel 26 through the locking aperture 38 in wrapper base panel 24. Upward pivotal movement is restricted by means of a pin 45 provided by the carrier block 44 which engages a peripheral part of an aperture 47 formed in the locking element. During this part of the locking procedure, the locking device has travelled from the position of device 16 in FIG. 1 to the position of device 18 in FIG. 1. The locking element 50 will remain in its locked position due to the insertion of the locking finger 60 into the wrapper base panels.

The spacing of the first and second follower legs and the relative positions of the first and second cam discs is chosen such that, during cooperation between the first follower leg 56 and the first cam disc 62, the second follower leg 58 automatically is brought into a position for engagement with the second cam disc 66 as shown in FIGS. 1 and 2.

Unlike the first cam disc, the second cam disc 66 has a flared configuration in that it has a convex peripheral edge 76 which is of decreasing diameter as measured from one disc face 78 to the opposite disc face 80, as best seen in FIGS. 2 and 3. In order to effect pivotal movement of the locking element 50 into its retracted position the second follower leg and cam disc are thus positioned for interference with one another such that the second follower leg 58 strikes an upper part of the peripheral edge 76 adjacent the larger diameter face 78 of cam disc 66 and is caused to ride on the peripheral edge whilst simultaneously moving downwardly across the peripheral edge from the larger diameter disc face 80 during rotation of the disc. This cooperation between the second follow leg and cam disc results in the locking element being pivoted into its retracted position as illustrated in FIG. 3. Thus, the locking finger 60 is positively withdrawn from the wrapper base panels. As shown during this movement the peripheral edge of cam disc 66 is received within the space between follower legs 56 and 58. Downward pivotal movement of the locking element is restricted by cooperation between pin 45 and aperture 47.

During this part of the locking procedure, the locking device has travelled from the position of device 20 in FIG. 1 to the position of device 22 in FIG. 1. It will be appreciated that during cooperation between the second follower leg 58 and the second cam disc 66, the first follower leg 56 automatically is brought into a position for engagement with the first cam disc 62 for initiation of a further locking sequence. If desired, another cam disc similar to the cam disc 66 may be positioned immediately upstream of cam disc 62 to counteract the effect of centrifugal forces acting on the locking elements as they travel around the mechanism. Such forces may cause the locking elements to be displaced out of correct alignment for cooperation between the first follower leg 56 and cam disc 62.

The rotational speed of the cam discs is chosen so as to approximate the linear speed of the locking devices moving along the carton conveyor path whereby friction between the follower legs and cam discs is minimized.

It is envisaged that the peripheral edge of second cam disc 66 need not have the arcuate convex configuration shown, although this is preferred. Pivoting of the locking elements into a retracted position may be achieved, for example, with a simple frusto-conical cam disc.

What is claimed is:

1. A locking mechanism for locking together overlapping base panels of a wrap-around carton, which mechanism includes carton conveying means, a locking element, and means pivotally mounting said locking element about a pivot axis on said conveying means for movement therewith, said locking element comprising a locking finger for insertion into said base panels to form a lock therebetween and a bifurcated portion providing a first cam follower leg and a second cam follower leg, a first cam surface located in the path of said first cam follower leg for engagement therewith to pivot said locking element so that said locking finger moves into locking position, a second cam surface located in the path of movement of said second cam follower leg for engagement therewith and effective to pivot said locking element so that said locking finger is moved into retracted position, said first and second cam surfaces being spaced apart in the path of movement of said locking element whereby said first and second locking fingers alternately engage said first and second cam surface, respectively, characterized in that said first cam surface comprises a rotatable disc having a constant diameter as measured across its peripheral edge and said second cam surface comprises a rotatable disc having a convex peripheral edge which is of decreasing diameter.

2. A locking mechanism according to claim 1 further characterized in that said first and second follower legs are spaced apart from one another so as to receive said convex peripheral edge of the second cam disc therebetween during pivoting of said locking element into its retracted position.

3. A locking mechanism according to claim 2, further characterized in that said locking finger is carried by said first follower leg remote from the pivot axis, said second follower leg being disposed intermediate the pivot axis and said first follower leg.

4. A locking mechanism according to claim 3, further characterized in that said first and second cam followers extend in a direction opposite to that of said locking finger.

* * * * *